US005395081A

United States Patent [19]

Vollink

[11] Patent Number: 5,395,081

[45] Date of Patent: Mar. 7, 1995

[54] SQUARE POST MOUNTED HANGER

[75] Inventor: Dan H. Vollink, Whitehall, Mich.

[73] Assignee: Dec-Kor, Inc., Whitehall, Mich.

[21] Appl. No.: 89,739

[22] Filed: Jul. 9, 1993

[51] Int. Cl.[6] ..... A47B 96.06

[52] U.S. Cl. ..... 248/218.4; 47/47; 248/27.8; 248/217.1; 248/300; 248/311.2

[58] Field of Search ..... 248/217.1, 27.8, 218.4, 248/311.2, 312.1, 314, 315, 300, 309.1, 219.1; 47/47 S

[56] References Cited

U.S. PATENT DOCUMENTS

| | | | |
|---|---|---|---|
| D. 236,051 | 7/1975 | Opincar . | |
| D. 253,079 | 10/1979 | Hill . | |
| D. 305,299 | 1/1990 | Freeman | 248/27.8 X |
| 308,005 | 11/1884 | Steinebrei . | |
| 678,679 | 7/1901 | McIntyre . | |
| 1,054,228 | 2/1913 | Medlin . | |
| 1,098,945 | 6/1914 | Frederick | 248/217.1 X |
| 1,153,320 | 9/1915 | Klenck | 248/217.1 |
| 1,799,944 | 4/1931 | Beardsley . | |
| 2,448,406 | 10/1949 | Paine | 248/903 X |
| 2,481,604 | 9/1949 | Lorenzen . | |
| 2,774,562 | 12/1956 | Henry . | |
| 3,108,828 | 10/1963 | Kus . | |
| 3,127,144 | 3/1964 | Warner . | |
| 3,204,904 | 9/1965 | Peterson | 248/125 |
| 3,381,824 | 5/1968 | Blumenschein . | |
| 4,747,506 | 5/1988 | Stuchlik, III | 248/218.4 X |
| 4,863,134 | 9/1989 | Young et al. | 248/311.2 |
| 5,085,391 | 2/1992 | Berger et al. . | |
| 5,118,059 | 6/1992 | Mainer . | |

FOREIGN PATENT DOCUMENTS

| | | |
|---|---|---|
| 0206425 | 11/1923 | Denmark . |
| 0073636 | of 1948 | Norway . |

*Primary Examiner*—Ramon O. Ramirez

*Attorney, Agent, or Firm*—Price, Heneveld, Cooper, DeWitt & Litton

[57] ABSTRACT

The specification discloses a stamped metal plant or like object support bracket including a generally "C" shaped opening which receives a four-by-four support post, an object support member for holding a plant or the like, and teeth which project into one side of the "C" shaped opening and engage the four-by-four post.

32 Claims, 3 Drawing Sheets

SQUARE POST MOUNTED HANGER

BACKGROUND OF THE INVENTION

The present invention relates to devices for supporting potted plants or other ornamentation. The most commonly used methods for supporting plants and other ornamentation from posts, fences, the side of a house, and the like include the use of threaded hooks and bracket and screw assemblies, both of which require at least some permanent attachment and disfigurement to the support. Moreover, methods involving bracket and screws require at least some subassembly before the mounting unit is in its completed form.

U.S. Pat. Des. No. 236,051 discloses a molded plastic ring joined to a canted, molded plastic arm. U.S. Pat. No. 2,774,562 discloses a similar method for supporting vases, pots, and the like, whereby a metal loop is connected to a canted metal arm and brace assembly. Both devices make use of a canted support arm as a counterforce to the pressure from the weight of the potted plant, vase, lamp, and the like.

SUMMARY OF THE INVENTION

The present invention is a post-mountable bracket for supporting potted plants or the like, having a generally "C" shaped opening for embracing a post, with an object support projecting from the base leg of the "C, " away from the "C" shaped opening, and post-engaging teeth projecting from the other side of the base leg into the opening. The bracket is mounted by sliding the "C" shaped portion over the side of the post. When a potted plant, for example, is positioned on the object support portion of the bracket, the weight of the plant forces the teeth to bite down and into the wooden post, preventing the bracket from sliding down the post.

The one-piece construction of the bracket permits its inexpensive manufacture, by stamping the bracket out of a piece of sheet metal. These and other objects and advantages of the invention will be more fully understood and appreciated by reference to the drawings and a detailed description of the preferred embodiments set forth below.

DESCRIPTION OF THE PREFERRED EMBODIMENT

Figure 1:
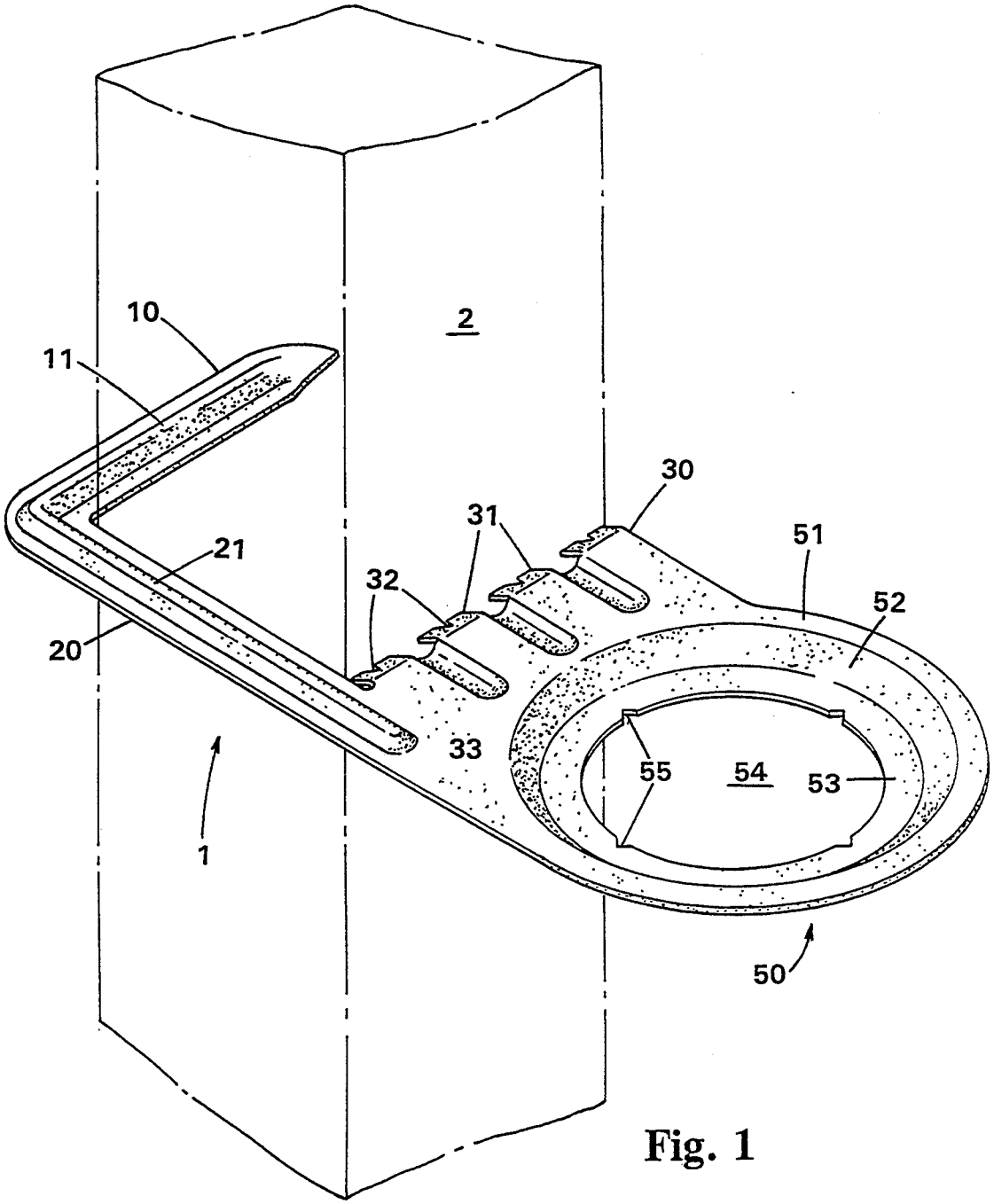
FIG. 1 is a perspective view of the bracket engaging a wooden post drawn in "phantom" lines.

In the preferred embodiment, bracket 1 includes support arm 10 and a spaced support arm 30 joined by connecting arm 20 to define a generally "C" shaped opening (FIG. 1). An object support member 50 projects from support arm 30. Post-engaging teeth 31 project from support arm 30 towards the "C" shaped opening 40.

Bracket 1 is generally flat and is preferably stamped from a single piece of sheet metal, with said "C" shaped opening 40 (FIGS. 2 and 3) dimensioned to fit around a four-by-four inch post. This method of construction reduces manufacturing expenses.

Figure 2:
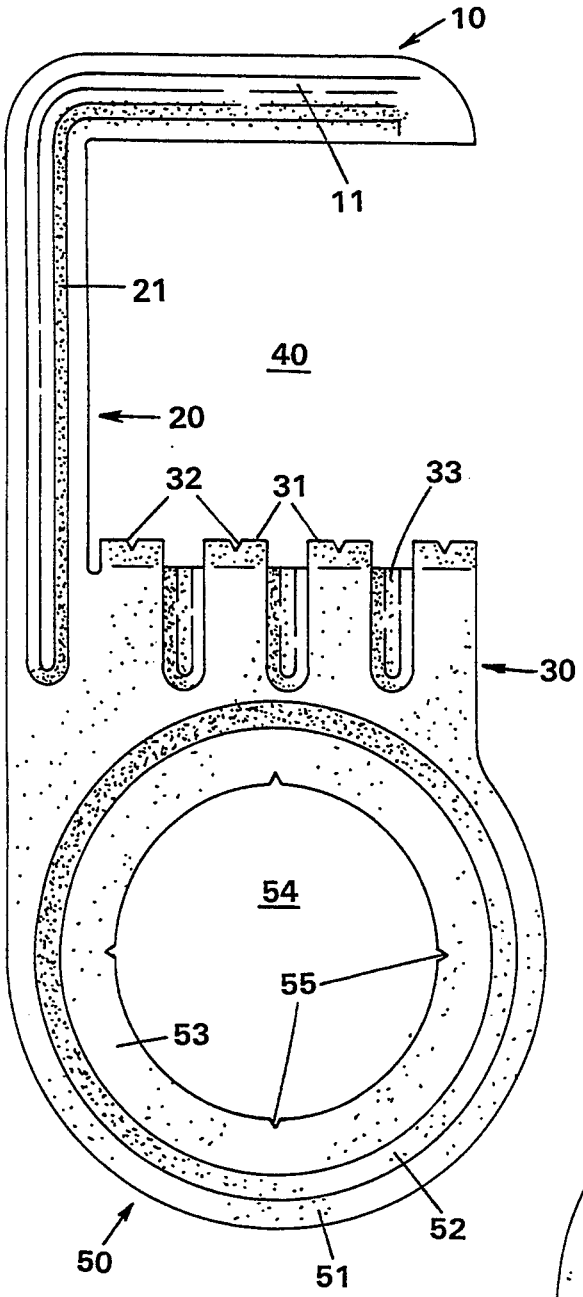
FIG. 2 is a top plan view of the bracket.
Figure 3:
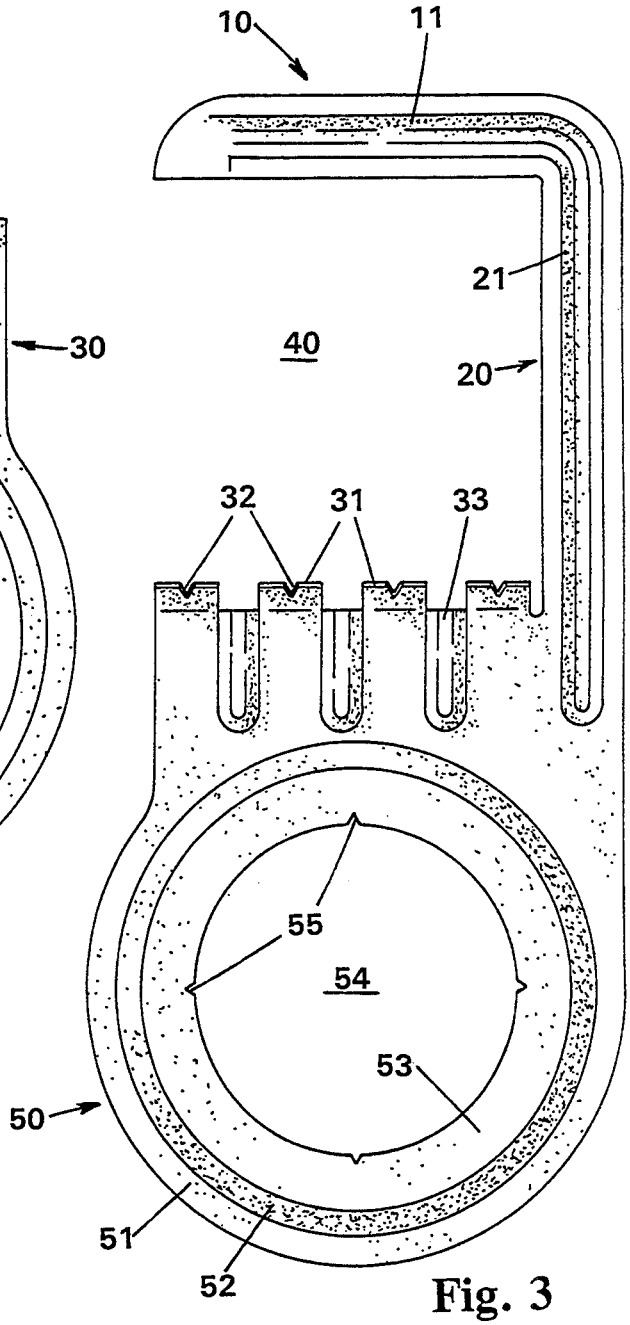
FIG. 3 is a plan view of the bracket.
Figure 4:
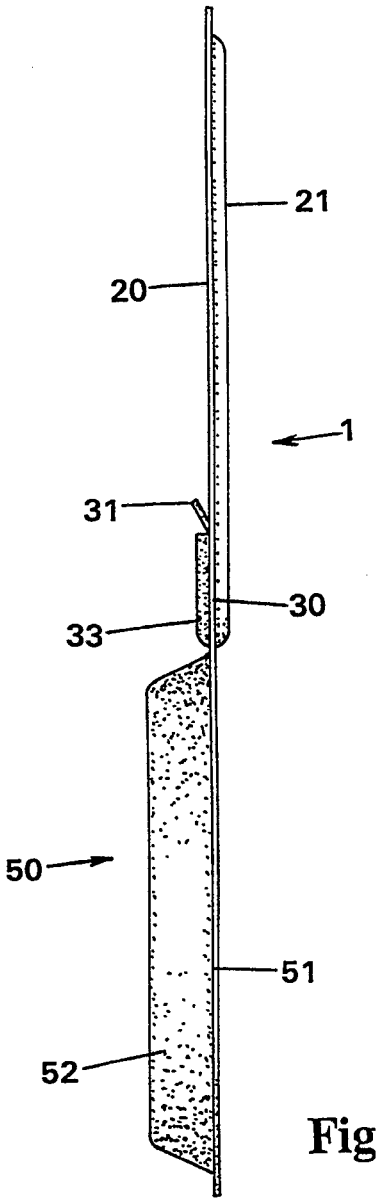
FIG. 4 is a right side elevational view of the bracket.
Figure 5:
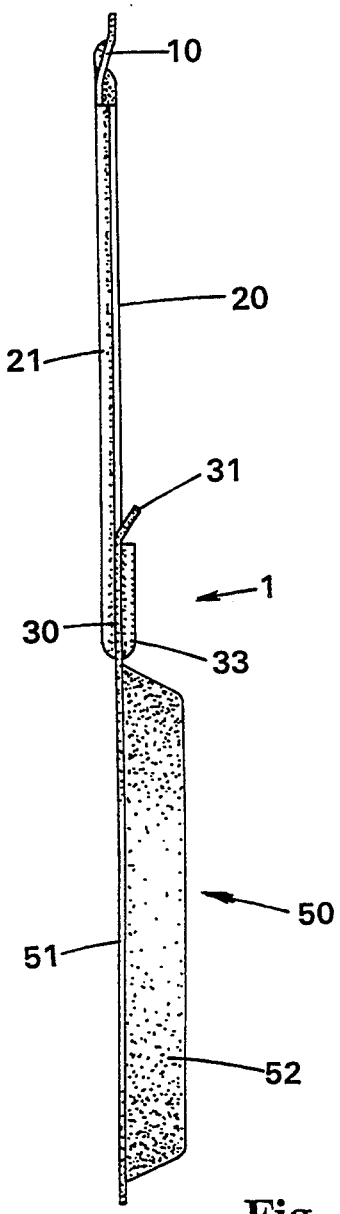
FIG. 5 is a left side elevational view of the bracket.
Figure 6:
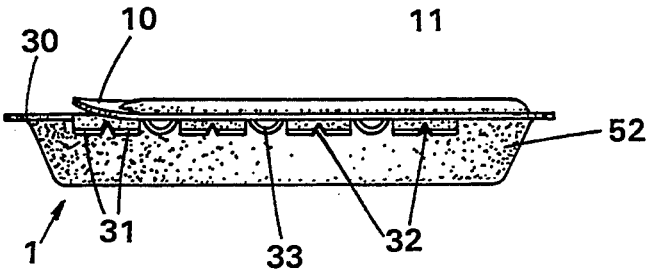
FIG. 6 is a rear end elevation of the bracket.
Figure 7:
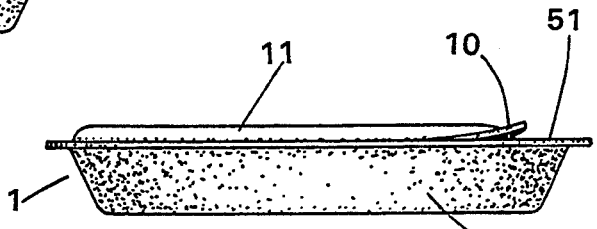
FIG. 7 is a front end elevation of the bracket.

Support leg 10 is approximately four inches long and thin in appearance (FIG. 5). Support leg 10 is also relatively flat, but for an upwardly protruding structural rib 11 (FIGS. 1, 2 and 3). Joining arm 20, virtually identical to support arm 10, is also approximately four inches long and contains a like upwardly protruding structural rib 21. Structural rib 21 is a continuation of rib 11 and extends into and across the end of support arm 30. (The inside edges of support leg 10, joining arm 20 and support leg 30 are about 3½ inches in length, to accommodate a standard 4×4 post.) Second support arm 30 contains a series of downwardly angled projecting post-engaging teeth 31 which extend into opening 40 (FIGS. 1, 2, 3 and 6). Each tooth 31 is marked by a "V" shaped notch 32 in the post-facing edge of the tooth 31, which allows water and liquid fertilizer to drain away rather than be trapped between a tooth 31 and the post to which bracket 1 is mounted. Teeth 31 are separated by spaces or gaps which are aligned with structural indentations 33 in support arm 30. Structural indentations 33 serve not only as strengthening ribs, but also as channels to channel water and liquid fertilizers away from and off the face of bracket 1, through the gaps between teeth 31. The sheet metal of which bracket 1 is formed is of a type and thickness such that teeth 31 are bendable. This enables the customer to compensate for variations in post dimensions, either due to post aging or mill inconsistency.

Extending outwardly from support leg 30 and away from post opening 40, is object support member 50 (FIG. 2). Object support member 50 in the preferred embodiment is dish-shaped, including an outer rim 51, a downwardly sloping annular wall 52, an inner rim 53, and a circular opening 54 (FIGS. 1, 2 and 3). The diameters of opening 54, the outer diameter of ledge 53 and the outer diameter at the top of annular shape wall 52 are 3 inches, 4 inches and 4½ inches respectively, to accommodate 3-inch, 4-inch, 5-inch and 6-inch posts. Inner rim 53 is also marked by a series of "V" shaped drainage notches 55 (FIG. 1).

In the preferred embodiment, bracket 1 is mounted to a four-by-four wooden post such that support arm 10, joining arm 20, and support arm 30 abut and embrace a wooden post 2. Post-engaging teeth 31 prevent the bracket 1 from sliding down the post by biting into said post when a vase, pot, or the like, is placed either in opening 54 or on inner rim 53 of object support member 50. Support arm 10, in turn, prevents the teeth 31 from disengaging the wooden post by resting securely against the side of the post opposite both support arm 30 and object supporting member 50. Thus, when a plant or other ornamentation is placed in opening 54 or on inner rim 53 of object support member 50, support arm 10 and, particularly, the post-engaging teeth 31 act in conjunction to maintain the vertical position of bracket 1 on the post (FIG. 1).

Object support 50 will accommodate several different sizes of pots. A larger pot will set on downwardly recessed rim 53, with annular wall 52 preventing it from falling off. Smaller pots will fit down into opening 54, with their sloped sidewalls or upper rims engaging rim 53. Drainage notches 55 allow water to drain past a pot positioned within opening 54.

Of course, it is understood that the above is merely a preferred embodiment of the invention and that various changes and alterations can be made without departing from the spirit and broader aspects thereof.

The embodiments of the invention in which an exclusive property or privilege is claimed are defined as follows:

1. A post-mountable bracket for supporting objects, comprising:

first and second spaced supporting arms for engaging opposite sides of a post, connected by a joining arm, said first, second, and joining arms defining a generally "C" shaped opening defining a generally horizontal plane, whereby said bracket can be mounted on a post with said post located within said "C" shaped opening and said first and second supporting arms engaging opposite sides of said post;

an object supporting member projecting from said second supporting arm away from said generally "C" shaped opening;

teeth projecting down from said second supporting arm into said generally "C" shaped opening for engaging a post located in said "C" shaped opening to help keep said bracket from sliding down said post when an object is placed on the supporting member; and downwardly protruding structural indentations between adjacent ones of said teeth.

2. The post-mountable bracket of claim 1, in which the object support member is substantially comprised of a dish-shaped support configuration.

3. The post-mountable bracket of claim 1 in which said teeth are bendable so that said bracket can accommodate variations in post dimensions.

4. The post-mountable bracket of claim 1 including a generally "V" shaped notch in the post-facing edges of each of said teeth.

5. The post-mountable bracket of claim 1, in which the object support member is of a dish-shaped configuration.

6. The post-mountable bracket of claim 5, in which said dish-shaped configuration is defined by an outer rim and a spaced lower inner rim joined by a downwardly sloping annular wall, said inner rim circumscribing an opening to permit vases or other ornamentation to be rested either in said opening or on top of said rim.

7. The post-mountable bracket of claim 6, in which said rim contains drainage notches at the edge of said opening.

8. The post-mountable bracket of claim 5, in which the first support arm and joining arm contain an upwardly protruding structural support rib.

9. The post-mountable bracket of claim 8, in which said bracket is stamped from a single piece of sheet metal.

10. The post-mountable bracket of claim 9, in which said bracket is of a relatively flat configuration.

11. The post-mountable bracket of claim 5, said bracket comprising a relatively flat configuration.

12. The post-mountable bracket of claim 11, in which said bracket is stamped from a single piece of sheet metal.

13. The post-mountable bracket of claim 1, said bracket comprising a relatively flat configuration.

14. The post-mountable bracket of claim 13, in which said bracket is stamped from a single piece of sheet metal.

15. The post-mountable bracket of claim 1, said bracket comprising a relatively flat configuration.

16. The post-mountable bracket of claim 15, in which said bracket is stamped from a single piece of sheet metal.

17. The post-mountable bracket of claim 1, in which said bracket is stamped from a single piece of sheet metal.

18. The post-mountable bracket of claim 17 in which said teeth are bendable so that said bracket can accommodate variations in post dimensions.

19. The post-mountable bracket of claim 1, in which the first support arm and joining arm contain an upwardly protruding structural support rib.

20. A post-mountable bracket stamped from a single piece of sheet metal for supporting objects, comprising:

first and second spaced supporting arms for engaging opposite sides of a post, joined by a joining arm, said first, second, and joining arms defining a generally "C" shaped opening whereby said bracket can be mounted on a post with said post located within said "C" shaped opening and said first and second supporting arms engaging opposite sides of said post;

an object supporting member projecting from said second supporting arm away from said generally "C" shaped opening; and said bracket, including both said first and second supporting arms, said joining arm and said object supporting member being generally in a common plane, thereby giving said support a relatively flat overall configuration.

21. The post-mountable bracket of claim 20, in which said object support member is of a shallow dish-shaped support configuration.

22. The post-mountable bracket of claim 21, in which said dish-shaped configuration is defined by an outer rim and a spaced lower inner rim joined by a downwardly sloping annular wall, said inner rim circumscribing an opening to permit vases or other ornamentation to be rested either in said opening or on top of said rim.

23. The post-mountable bracket of claim 20, in which said object support member is of a shallow dish-shaped support configuration.

24. The post-mountable bracket of claim 20, in which said first support arm and said joining arm contain an upwardly protruding structural support rib.

25. The post-mountable bracket of claim 23, in which said dish-shaped configuration is defined by an outer rim and a spaced lower inner rim joined by a downwardly sloping annular wall, said inner rim circumscribing an opening to permit vases or other ornamentation to be rested either in said opening or on top of said rim.

26. A mounting bracket for supporting objects such as potted plants from a post, comprising:

a pair of spaced arms interconnected to form a "C" shaped opening for engaging opposite sides of the post;

a supporting member extending from one of said pair of spaced arms for supporting the object;

a plurality of angular adjustable projections extending into said "C" shaped opening from said one of said pair of spaced arms, for engaging one of said opposite sides of the post to prevent the mounting bracket from sliding down the post.

27. A post-mountable bracket for supporting objects, comprising:

first and second spaced supporting arms for engaging opposite sides of a post, connected by a joining arm and having a relatively flat configuration, said first, second and joining arms defining a generally "C" shaped opening whereby said bracket can be mounted on a post with said post located within said "C" shaped opening and said first and second supporting arms engaging opposite sides of said post;

an object supporting member projecting from said second supporting leg away from said generally "C" shaped opening; and said object support member being of a generally dish-shaped configuration.

28. The post-mountable bracket of claim 27, in which said bracket is stamped from a single piece of sheet metal.

29. The post-mountable bracket of claim 27, in which said dish-shaped configuration is defined by an outer rim and a spaced lower inner rim joined by a downwardly sloping annular wall, said inner rim circumscribing an opening to permit vases or other ornamentation to be rested either in said opening or on top of said rim.

30. The post-mountable bracket of claim 29, in which said rim contains drainage notches at the edge of said opening.

31. The post-mountable bracket of claim 30, in which said bracket is stamped from a single piece of sheet metal.

32. The post-mountable bracket of claim 31, said bracket comprising a relatively flat configuration.

* * * * *